US005738150A

United States Patent [19]

Roelstraete

[11] Patent Number: 5,738,150

[45] Date of Patent: Apr. 14, 1998

[54] WEAVING MACHINE COVER

[75] Inventor: Kristof Roelstraete, Zwevegem, Belgium

[73] Assignee: Picanol N.V., Leper, Belgium

[21] Appl. No.: 750,528

[22] PCT Filed: Jun. 9, 1995

[86] PCT No.: PCT/EP95/02226

§ 371 Date: Mar. 18, 1997

§ 102(e) Date: Mar. 18, 1997

[87] PCT Pub. No.: WO95/34701

PCT Pub. Date: Dec. 21, 1995

[30] Foreign Application Priority Data

Jun. 15, 1994 [BE] Belgium ..... 09400575

[51] Int. Cl.[6] ..... D03D 49/02; D03J 1/00

[52] U.S. Cl. ..... 139/1 C

[58] Field of Search ..... 57/308; 15/301; 139/1 R, 1 C

[56] References Cited

U.S. PATENT DOCUMENTS

| | | | |
|---|---|---|---|
| 3,391,528 | 7/1968 | Schackelford et al. | 57/304 |
| 3,627,201 | 12/1971 | Partsch | 139/1 C |
| 3,678,965 | 7/1972 | Yamada | 139/1 C |
| 5,524,676 | 6/1996 | Scorl et al. | 139/1 C |

FOREIGN PATENT DOCUMENTS

| | | |
|---|---|---|
| 0 565 958 | 1/1993 | European Pat. Off. . |
| 2 388 067 | 11/1978 | France . |
| 2 431 562 | 6/1979 | France . |
| 2 059 461 | 4/1981 | United Kingdom . |

*Primary Examiner*—Andy Falik

*Attorney, Agent, or Firm*—Bacon & Thomas

[57] ABSTRACT

A weaving machine having mutually separable major assemblies wherein the region between a back rest (7) preferably together with a warp beam (4) associated with one machine assembly (2) and means (9) for removing the fabric (12) and associated with the other assembly (1) is covered by an upper shield and/or a lower shield. The shields are composed of sets of mutually complementing cover pairs (23, 24; 27, 28), with each cover mounted to one of the assemblies.

17 Claims, 7 Drawing Sheets

WEAVING MACHINE COVER

BACKGROUND OF THE INVENTION

The invention concerns a weaving machine having two mutually separable major assemblies of which one assembly contains at least means for removing a manufactured fabric and of which the other assembly contains at least a warp-beam support.

RELATED ART

A weaving machine of the above type is known for instance from the European patent document EP 0 565 958 A2 and offers substantial advantages as regards changing articles and/or warp-beams because such work need not be carded out directly at the weaving machine but for instance may be carried out remotely where more space is available.

It is further known to encapsulate a weaving machine wholly or in part using shielding means in order to establish a micro-climate in the vicinity of the machine. This micro-climate may be improved further by local airconditioning and dust removal. Shields of acoustically insulating material are used furthermore to reduce noise pollution from the weaving machine. It is further known to fit the shields with drive means to automatically open these shields in case of yarn rupture so that the weaving operator can proceed unhampered when remedying the yarn rupture. However the known shields incur the substantial drawback that they present considerable impediments to changing warp beams and/or articles, in particular if it is necessary to exchange the weaving frames, the reed and the warp stop-motion, in addition to the warp beam.

The object of the invention is to so enclose a weaving machine of the above described type by shields that changing a warp beam and/or articles can be carried out very easily.

BRIEF DESCRIPTION OF THE INVENTION

This problem is solved by using an upper and/or a lower shield between the back rest and the fabric-removing means, the lower and/or the upper shield being composed of a set of covers each mounted on one of the major assemblies and complementing the lower and/or upper shield when the assemblies are joined to each other.

In this design the covers will not be obstructing when one of the separable assemblies together with the warp beam is being removed from the other assembly or is joined to it again. Furthermore the covers present no impediment during a change of warp beam and/or articles.

In a preferred embodiment of the invention the upper shield is composed of a set of covers each mounted to one of the major assemblies and complementing one another to form the upper shield when the said assemblies are joined together. As a result, when the two major assemblies are being separated, each will be amply cleared and thereby will be well accessible for cleaning.

Further features and advantages of the invention are elucidated in the following description of the embodiments shown in the drawings.

DETAILED DESCRIPTION OF PREFERRED EMBODIMENTS OF THE INVENTION

Figure 1:
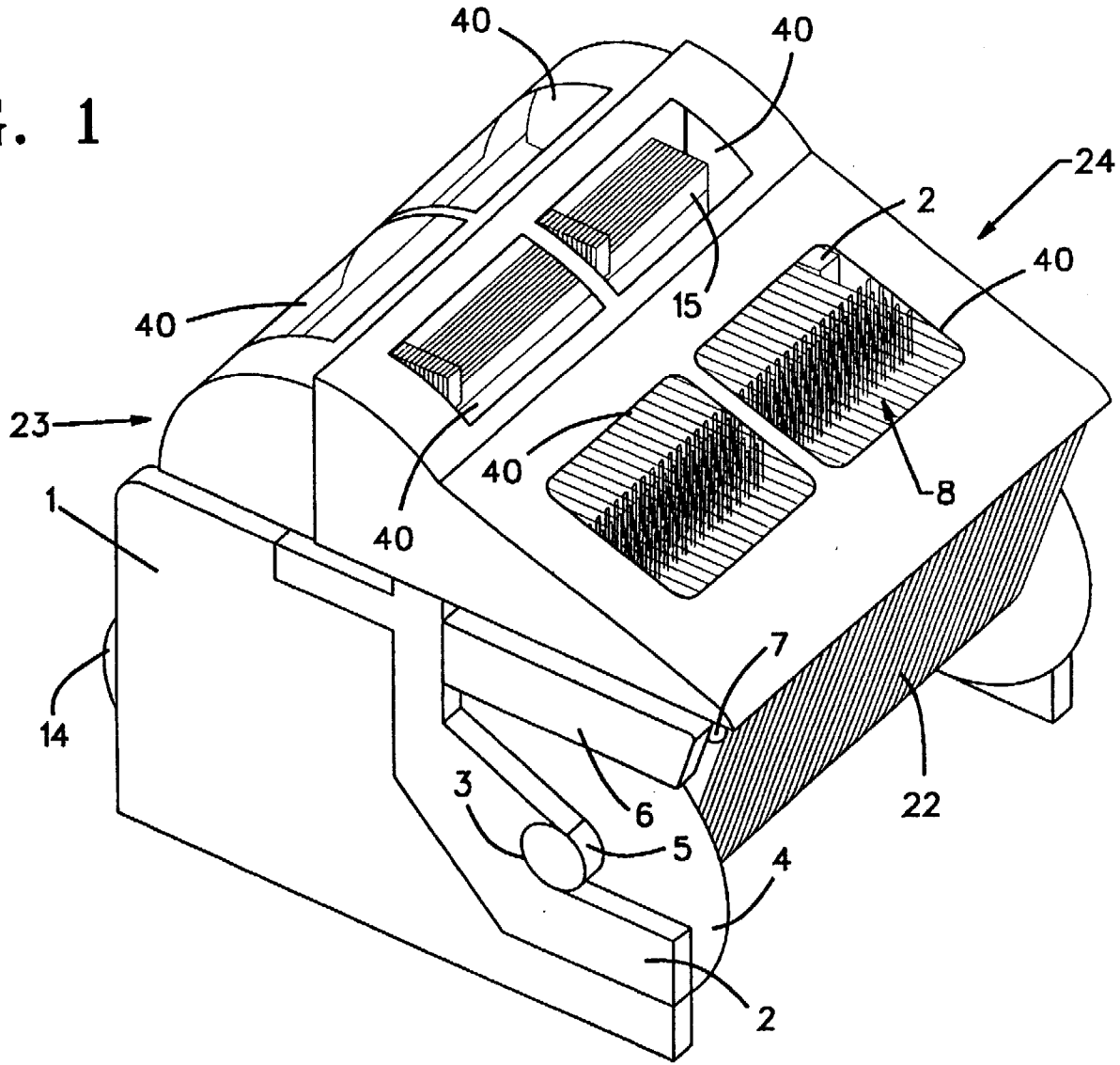
FIG. 1 is a schematic perspective of a weaving machine of the invention.
Figure 2:
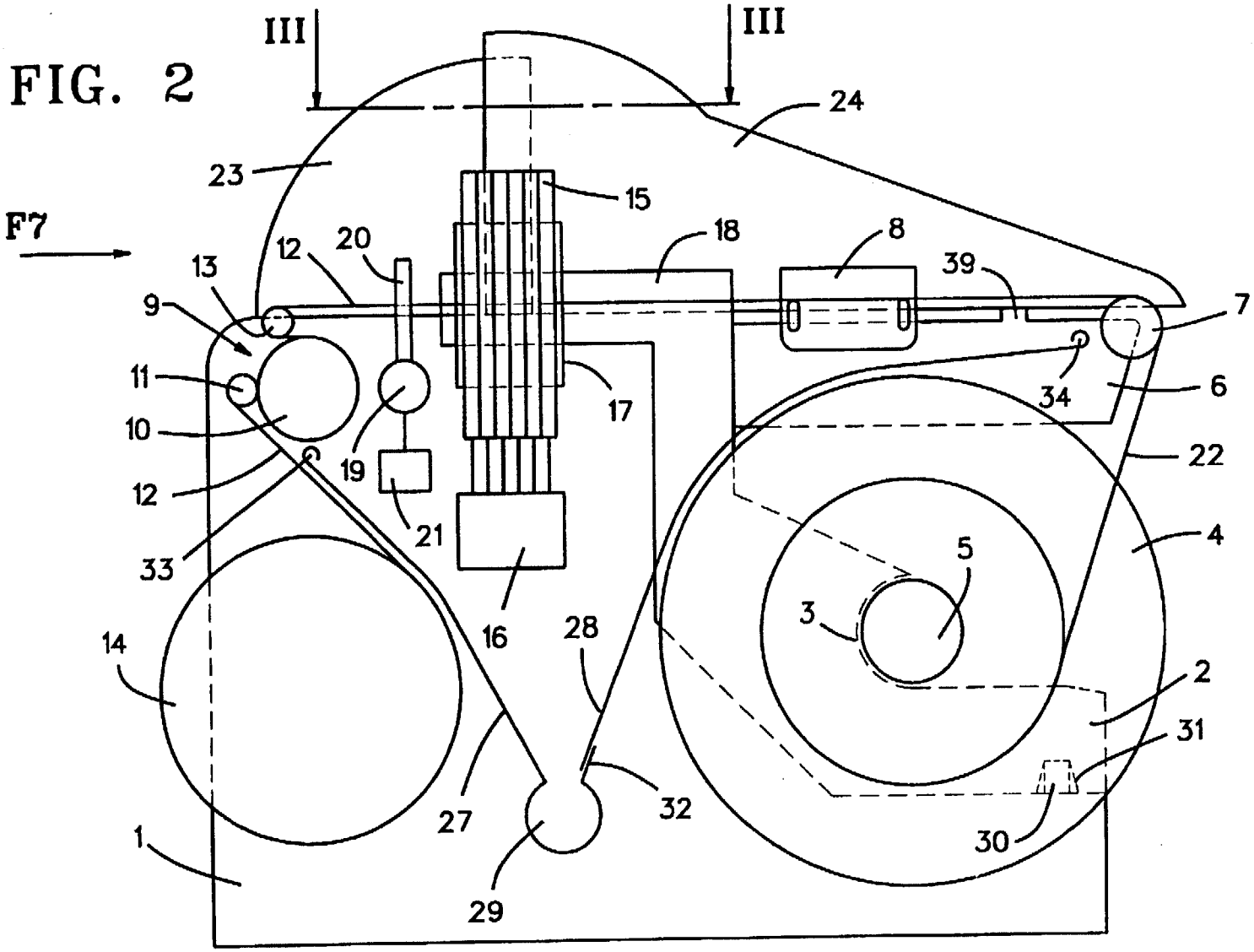
FIG. 2 is a sideview of the weaving machine of FIG. 1.

The weaving machine shown in FIGS. 1 and 2 comprises a first major assembly 1 and a second, separable major assembly 2. The second assembly 2 comprises two side frame parts linked by an omitted crosslink. The two side frame parts include the bearings 3 for a shaft 5 of a warp beam 4. Furthermore the side frame parts include affixation means 6 for a back rest 7 and a warp stop-motion 8.

The first major assembly 1 comprises means 9 to remove a fabric 12. In the shown embodiment, these means 9 include a driven sand roll 10 and a matching roll 11. The fabric 12 is guided before this means 9 around a breast beam 13. Beyond the removal means 9, the fabric 12 runs toward a cloth roller 14 on which it will be wound. The first assembly 1 also contains a drive 16 to move heddles 15 of a shed forming device up and down. These heddles are guided in guides 17 affixed to arms 18 of the side frame parts of the second assembly 2. The first assembly 1 also contains a reed batten 19 with a reed 20 and a drive unit 21 for the reed batten 19.

From the warp beam 4, the warps 22 run over the back rest 7 and then through the warp stop-motion 8 and the heddles 15 and through the fabric 12. The substantially horizontal plane tangential to the back rest 7 and the breast beam 13 hereafter is called the warp plane.

Figure 3:
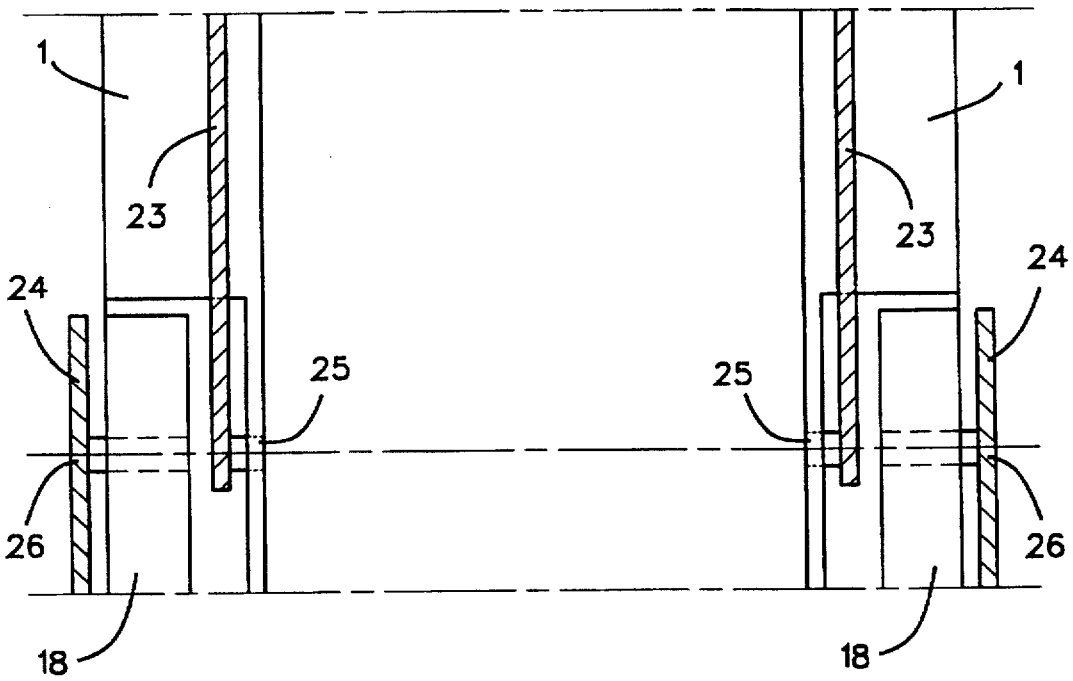
FIG. 3 is a section along line III—III of FIG. 2.

The weaving machine is fitted with two sets of cooperating and overlapping covers subtending an upper and a lower shield. A first set of cooperating covers is present substantially above the warp plane and forms the upper shield. This first set comprises a cover 23 mounted on the first assembly 1 and a second cover 24 mounted on the second assembly 2. As shown in FIG. 3, the cover 23 is affixed by hinges 25 to the first assembly, said hinges forming a horizontal pivot shaft running transversely to the warp plane. The cover 24 is affixed by hinges 26 to the arms 18 of the side frame parts of the second major assembly 2. The hinges 26 form a pivot shaft running coaxially to the pivot axis formed by the hinges 25. The cover 23 rests on the side frame parts of the first machine part 1. The cover 24 rests on projections 39 of the affixation means 6 of the back rest 7. The cover 23 extends beyond the breast beam 13, as a result of which both the fabric 12 and the warps 22 are protected against touching, damage or soiling. The covers 23 and 24 thereby form a shield protecting or enclosing upward the region between the breast beam 13 and the back rest 7.

The covers 23 and 24 are designed in such manner that they are mutually separable when the two assemblies 1, 2 are separated from each other and that they can also be joined to form an upper shield when the two assemblies 1, 2 again are joined together. Cover 24 mounted on the separable assembly 2 overlaps the cover 23 of the stationary first assembly 1. The edge of the cover 23 facing the second assembly 2 accordingly is located within the cover 24 of the second assembly 2.

As shown in FIG. 2, the weaving machine comprises a second set of cooperating covers 27, 28 substantially located below the warp plane and forming a lower shield. This second set comprises a cover 27 mounted on the first assembly 1 and a cover 28 mounted on the second assembly 2. The cover 27 is composed of a wall affixed to the first assembly 1 and extending between the side frame parts of the first assembly 1. The cover 27 sloped downwardly from the vicinity of the fabric-takeoff means 9 as far as the weaving machine's base region. The cover 27 is fitted with a gutter 29 in this lower region, said gutter 29 possibly being connected to a dust evacuating system (not shown). One dust evacuating system may be provided for each weaving machine. However a dust evacuating system also may be moved along several weaving machines to be sequentially moved along the gutters 29 of several weaving machines to evacuate their dust.

The cover 28 also is composed of a wall affixed to the second assembly 2 and is located between the two side frame parts of this assembly 2. Said cover 28 slopes down from the vicinity of the back rest 7 as far as the gutter 29 when the two assemblies 1 and 2 are joined. The cover 28 overlaps above the gutter 29 in such manner that the second assembly 2 and hence the cover 28 can be moved away from the gutter 29 in problem-free manner. The two assemblies 1 and 2 are fitted with cooperating guides 30, 31 designed in such a way that the second assembly 2 must be displaced along a specific path for its separation or for its reassembly to the stationary assembly 1. This embodiment provides that the end of said displacement path during reassembly and the beginning of the displacement path when separating the two assemblies 1 and 2 be essentially vertical. An extension 32 is affixed to the gutter 29 and overlaps the cover 28.

In another embodiment, the gutter 29 is non-integral with the cover 27. Illustratively the gutter 29 may be a separate component affixed to said cover 27 or it may also be mounted between the two side frame parts of the machine part 1.

The two covers 27, 28 form a lower shield in the region below the warp plane.

The ends of the covers 27, 28 remote from the gutter 29 are fitted with blowing devices 33, 34 of which the blow direction points along the covers 27 or 28 towards the gutter 29. Illustratively these blow devices 33, 34 may be connected by valves to a supply of compressed air, said valves automatically blocking the compressed-air feed when a cover 23 or 24 of the upper shield is being opened.

Figure 4:
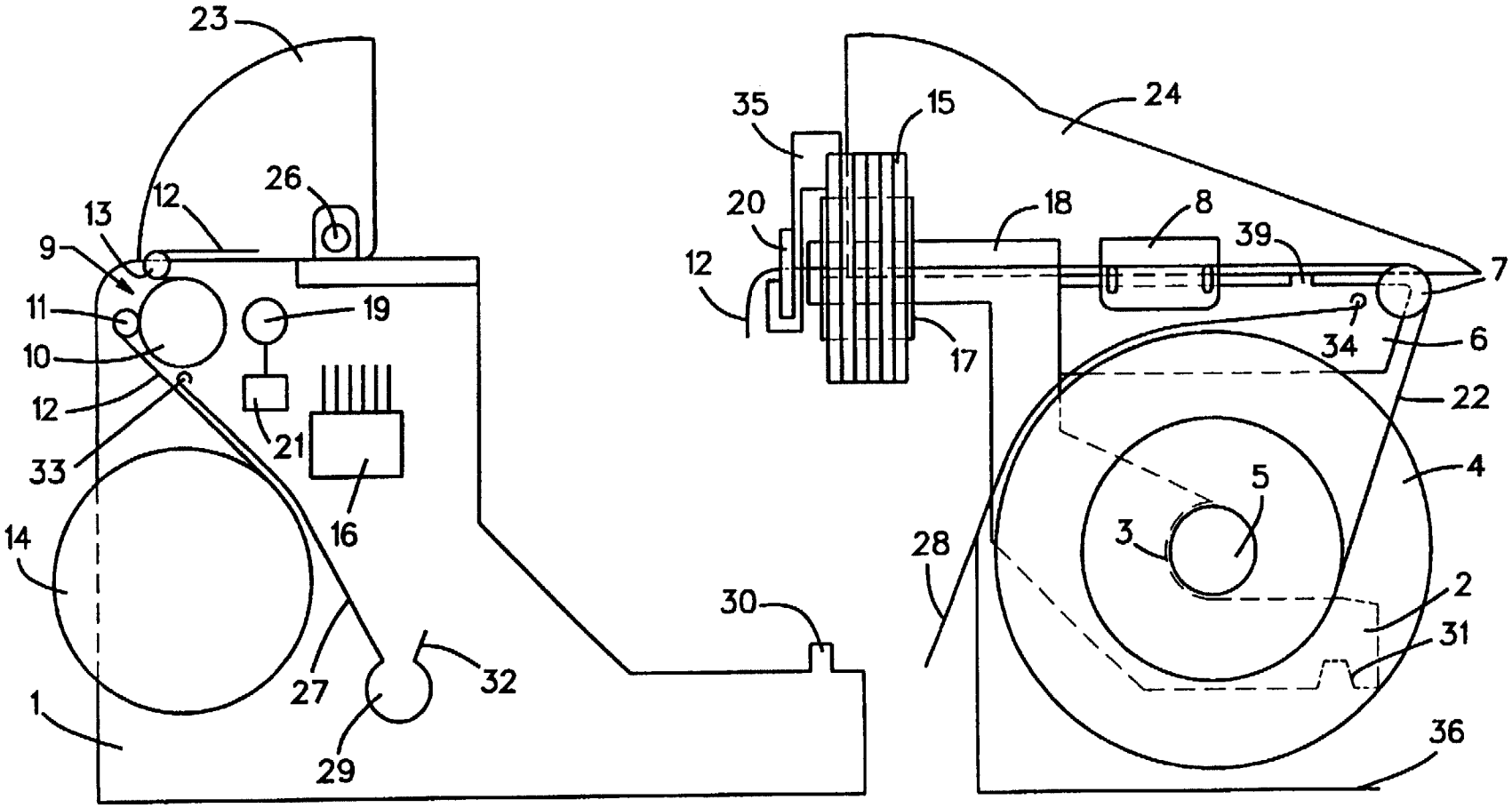
FIG. 4 is a sideview of the weaving machine of FIGS. 1 and 2 after the separable major assemblies have been moved away from each other.

FIG. 4 shows the weaving machine after the second assembly 2 has been separated from the first assembly 1. Prior to the separation of the two assemblies, the heddles 15 were separated from their drive 16 and held against the second assembly 2 by support elements (not shown). Illustratively, these support elements may assume the design shown in the European patent document EP 0 565 958 A2. The reed 20 also is separated from the reed batten 19 and is inserted into a holder 35 mounted on the first heddle 15. As further shown in FIG. 4, a support 36 is mounted to the cover 28 and permits placing the assembly 2 on a floor such that the warp beam 4 is located some distance above the floor. The covers 27, 28 designed to function as walls contribute to the mechanical rigidity of the two machine parts 1, 2.

When in the positions shown in FIG. 4, both the first assembly 1 and the second assembly 2 inclusive of the elements therein can be cleaned in a simple manner, for instance using a suction vacuum) system, or a combined blow and suction apparatus. The covers 23, 24, 27, 28 do not impede cleaning which may be carded out manually or also using a cleaning robot.

Figure 5:
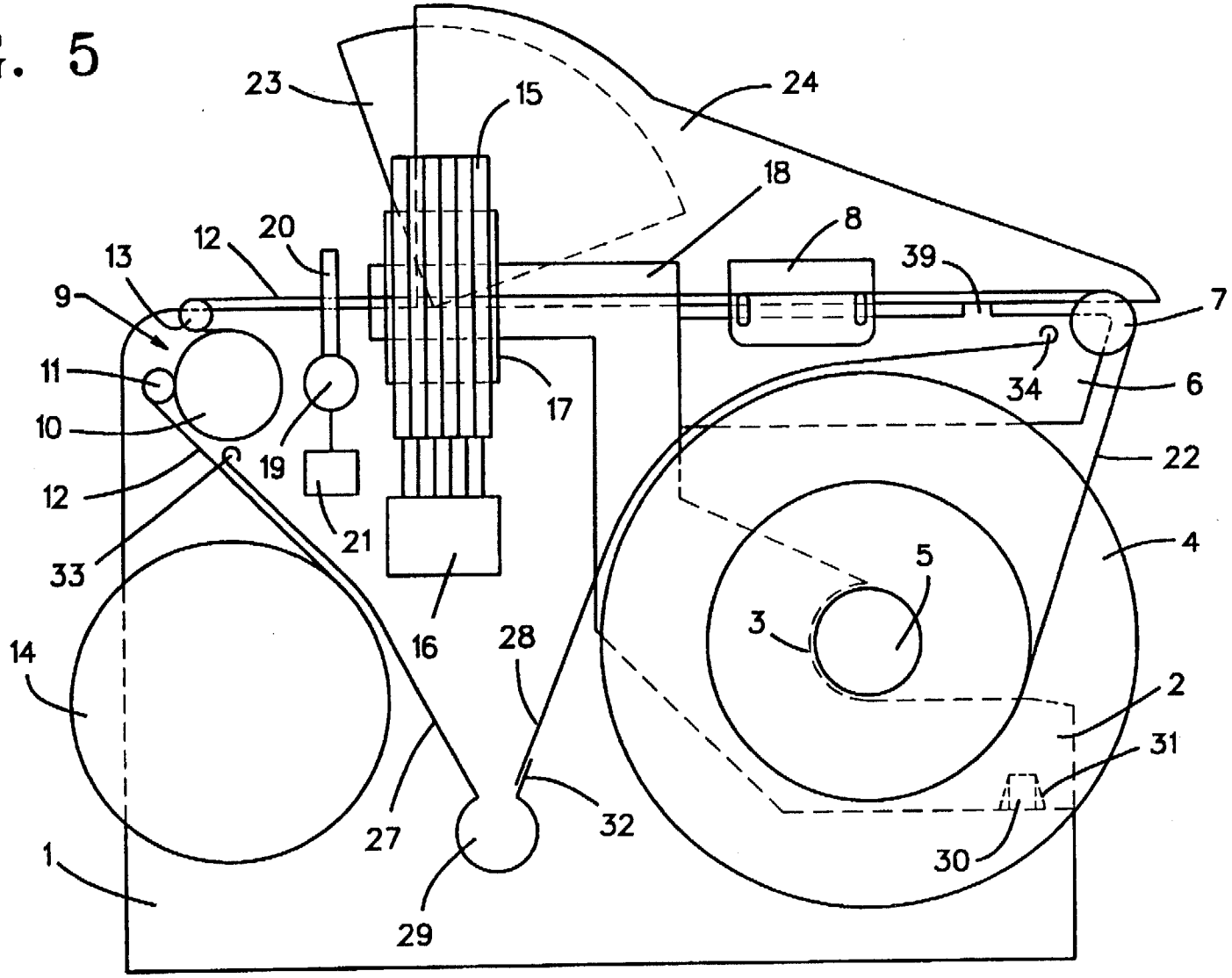
FIG. 5 is a sideview of the machine of FIG. 1 after a cover from the upper shield has been opened.
Figure 6:
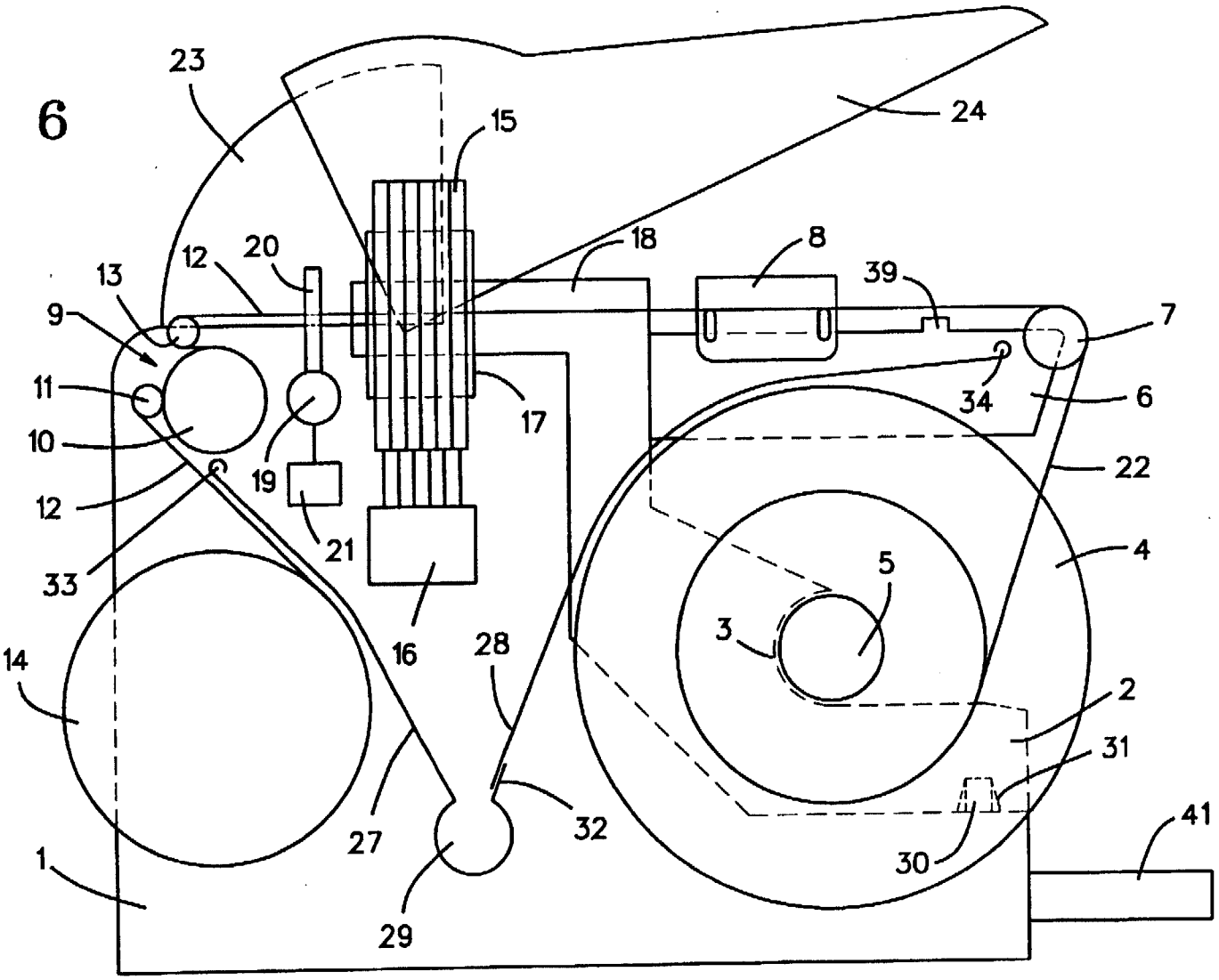
FIG. 6 is a sideview of the weaving machine of FIGS. 1 and 2 after a second cover of the upper shield has been opened.

As shown in FIGS. 1, 2, 5 and 6, the covers 23, 24 are in the shape of cowls together forming an upper shield in the form of an overall cowl shielding the warp plane from the top. The cover 23 constitutes one fourth of a cylinder surface fitted at its ends with arc-of-circle walls held by hinges. In its region facing the cover 23, the cover 24 also comprises an arc-of-circle surface with joining end walls held by hinges 26. As shown in FIG. 5, it is possible thereby to pivot the cover 23 about its hinge 25 by about 90° in such a way that it shall be substantially within the cover 24. Accordingly the weaving operator is able to easily access the region of the weaving frames 15 and the warps and fillings present therein. As shown by FIG. 6, the cover 24 is pivotable for instance by 60° about its hinge 26 and above the cover 23. Therefore the weaving operator may easily access the warps 22 in the vicinity of the back rest 7 and the warp stop-motion 8. The hinges 25, 26 forming the horizontal coaxial pivot shafts are located in the region of the heddles 15, as a result of which not only the heddles 15, but also the parts in front of and within them will be easily accessible.

Figure 7:
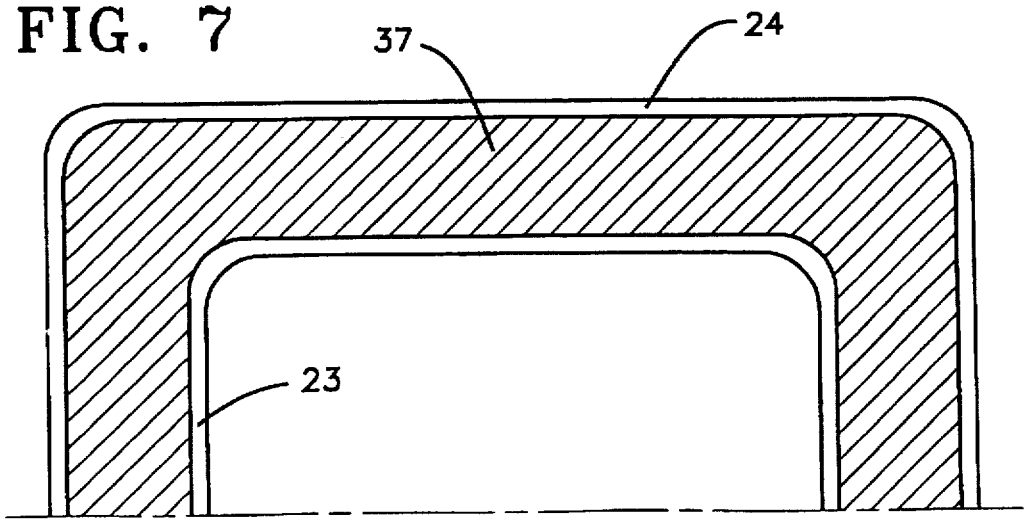
FIG. 7 is an elevation view in the direction of the arrow F7 of FIG. 2.
Figure 8:
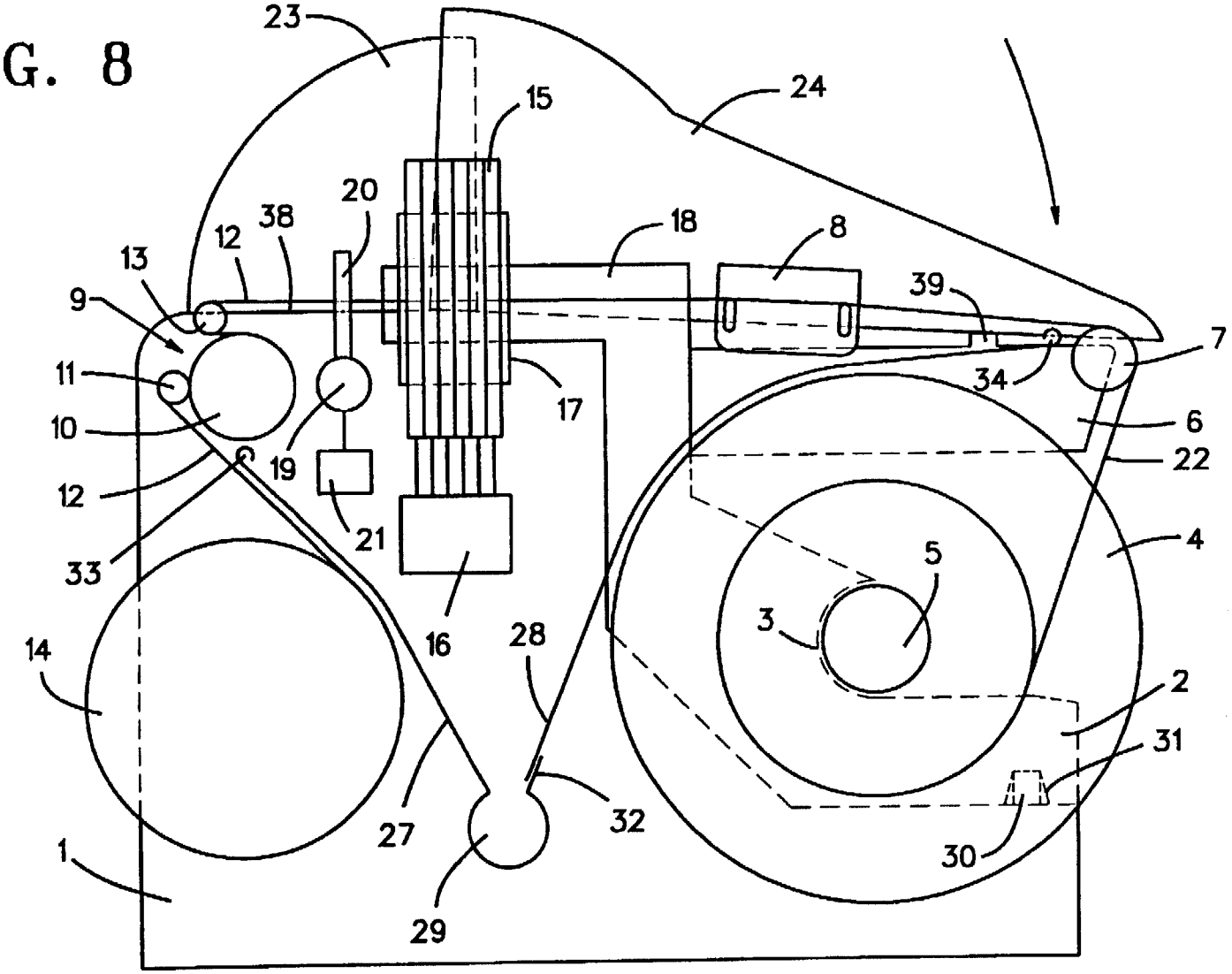
FIG. 8 is a sideview of the weaving machine of FIG. 2 for a different position of the back rest.

To reduce noise propagating from the weaving machine, a seal 37 is provided between the overlapping edges of the covers 23, 24 in the manner shown in FIG. 7. This seal consists of a rubbery resilient strip affixed to the inside of the cover 24. The seal 37 rests on the first assembly 1 when the first and second weaving major assemblies 1,2 are joined. As indicated in FIG. 8, the cover 23 rests on the side parts of the first assembly 1. The cover 23 is fitted with a seal 38 in the vicinity of the side frame parts, said seal 38 for instance also consisting of a strip of rubbery resilient material. In the closed position, the cover 24 is supported by a hinge 26 and a projection 39 of the holder 6. The covers 23 and 24 furthermore have such dimensions in their mutually facing zones that they still overlap even when the holder 6 is in a lower position shown in FIG. 8.

As shown in FIG. 1, the covers 23, 24 of the upper shield are fitted with windows 40 allowing observing of the weaving zone and in particular the warp stop-motion 8, the heddles 15 and also the filling insertion region, without needing to open the covers 23, 24.

In an embodiment not shown in the Figures, the covers 23, 24 are equipped with drives opening said covers 23 or 24 upon determination of filling or warp rupture (FIGS. 5, 6). Also switches, for instance pressure sensors, may be used to actuate said drives into opening the covers 23, 24. Moreover such a drive actuation may be implemented in remote, wireless manner.

As shown in FIG. 6, the weaving machine part 2 may be fitted with an extensible stepping board 41 comprising a drive automatically actuated when opening or closing the cover 24. In further designs, switches may also be provided wherein the opening of a cover 23 or 24 will stop a running weaving machine and/or prevent starting one if the cover 23, 24 is open. However such switches should not inhibit the running of a weaving machine operating at a so-called slow speeds.

In an embodiment variation, the covers 23, 24 forming the upper shield are both mounted on the second, separable assembly 2. The two covers 23, 24 being mutually displaceable, work involving a change in warp beam and/or article especially at the separated assembly 2 is reliable unhampered.

In yet another embodiment variation, the back rest 7 is mounted not on the separable assembly 2 but on the stationary assembly 1. When the assembly 2 together with the cover 28 are being separated, the first assembly 1 also will be amply cleared underneath the back rest and then shall be well accessible for cleaning.

I claim:

1. A weaving machine including a back rest and also including two separable major assemblies, a first one of said two assemblies including a device for removing a manufactured fabric and the second one of said assemblies including a support for a warp beam;

at least one shield located between the back rest and the device for removing the fabric;

said at least one shield comprising a pair of covers, each cover of said pair being mounted on one of said major assemblies so as to be separable from the other cover with a respective assembly when the assemblies are separated;

said covers arranged to cooperate with each other to shield a portion of the weaving machine when major assemblies are joined together.

2. A weaving machine as claimed in claim 1, wherein said at least one shield comprises an upper shield and a lower shield, each shield including a pair of covers and wherein each cover of said pair is mounted on one of the assemblies so as to be separable from the other cover with a respective assembly when the assemblies are separated;

said covers of each shield arranged to cooperate with each other to shield a portion of the weaving machine when the major assemblies are joined together.

3. A weaving machine as claimed in claim 2, wherein said upper shield is mounted on said second one of said assemblies.

4. A weaving machine as claimed in claim 2, wherein the region of the weaving machine between said back rest and said fabric removal device is substantially enclosed by said upper and lower shields.

5. A weaving machine as claimed in claim 1, wherein at least one shield is an upper shield, said upper shield shielding said second one of said assemblies.

6. A weaving machine as claimed in claim 5, including a means for mounting said upper shield such that each cover of said pair of covers is independently moveable to an open unshielding position.

7. A weaving machine as claimed in claim 6, wherein said mounting means comprises a respective pivot shaft for each cover of said pair of covers.

8. A weaving machine as claimed in claim 7, wherein said pivot shafts are coaxially positioned.

9. A weaving machine as claimed in claim 8, wherein said pivot shafts are mounted between the back rest and the fabric removing device.

10. A weaving machine as claimed in claim 9, wherein said weaving machine includes heddles, and said pivot shafts are mounted at the location of the heddles.

11. A weaving machine as claimed in claim 7, wherein said pivot shafts are mounted between the back rest and the fabric removing device.

12. A weaving machine as claimed in claim 5, wherein said pair of covers are cowl-shaped and together cover the region of the weaving machine between the back rest and the fabric removing device.

13. A weaving machine as claimed in claim 12, wherein said weaving machine includes side frame parts and said covers together extend to said side frame parts.

14. A weaving machine as claimed in claim 12, wherein one of said covers of said pair of covers partially overlaps the other of said covers, and including coaxial pivot shafts for mounting said covers for independent opening and closing movement relative to the weaving machine and each other.

15. A weaving machine as claimed in claim 1, wherein said at least one shield comprises a lower shield, said weaving machine including side frame parts and a lower base portion; said lower shield positioned between said side frame parts and in the area of said base portion.

16. A weaving machine as claimed in claim 15, said covers being inclined from a higher to a lower region and meeting at the lower region, and including a channel between said pair of covers at said lower region.

17. A weaving machine as claimed in claim 16, including a blower arranged to blow air along the shield covers from the higher region thereof towards said lower region.

* * * * *